US006462472B1

(12) United States Patent
Huang et al.

(10) Patent No.: US 6,462,472 B1
(45) Date of Patent: Oct. 8, 2002

(54) FIXING STRUCTURE FOR SAFETY FUSE OF CHRISTMAS LAMP

(76) Inventors: Chen Hsien Huang, No. 22, Alley 46, Lane 486, Ming-Hu Road, Hsinchu (TW); Kuo Chih Tseng, 12F, No. 523-1, Nan-Da Road, Hsinchu (TW)

( * ) Notice: Subject to any disclaimer, the term of this patent is extended or adjusted under 35 U.S.C. 154(b) by 0 days.

(21) Appl. No.: 09/548,006

(22) Filed: Apr. 12, 2000

(51) Int. Cl.[7] ..... H01K 1/26
(52) U.S. Cl. ..... 313/580; 313/579
(58) Field of Search ..... 313/623, 567, 313/573, 574, 578, 579, 580

*Primary Examiner*—Vip Patel
(74) *Attorney, Agent, or Firm*—Rosenberg, Klein & Lee

(57) ABSTRACT

The present invention proposes a fixing structure for the safety fuse of a Christmas lamp. The Christmas lamp of the present invention has two conductive filaments installed at two sides in a lamp casing. A fixing block is installed in the casing to fix the positions of the two conductive filaments. A tungsten filament is connected between the top ends of the two conductive filaments. The potion of the two conductive filaments between the tungsten filament and the fixing block is bent to form a fixing structure. A small section of safety fuse is exactly fixed on the two conductive filaments through the help of the fixing structure. Thereby good conductivity can be maintained, and material of safety fuse can be saved.

1 Claim, 4 Drawing Sheets

FIXING STRUCTURE FOR SAFETY FUSE OF CHRISTMAS LAMP

FIELD OF THE INVENTION

The present invention relates to a modified Christmas lamp and, more particularly, to a fixing structure for safety fuse of a Christmas lamp.

BACKGROUND OF THE INVENTION

Along with the increasing enhancement of living standard, people have been more and more appreciating the savor of living. Therefore, some occasional decorations are usually disposed, and there are many different celebration activities. For instance, to greet the advent of the Christmas, some strings of Christmas lamps are disposed on trees to decorate them as Christmas trees.

A general string of Christmas lamps is formed by connecting a plurality of Christmas lamps, with a safety fuse installed between the two lamp filaments in each Christmas lamp. When the tungsten filament of a Christmas lamp bums out, higher current will bum the outer insulation of the safety fuse therein such that the two lamp filaments can conduct current via the safety fuse. Although the damaged lamp can not glow, other lamps still can emit light. The user can replace the damaged lamp with a new one. If damaged lamps accumulate to a certain amount such that replacement is not feasible, the loading of the safety fuses of damaged lamps will too high and the safety fuses will bum out. The whole string of Christmas lamps can not emit light anymore. Thereby safety consideration can be enhanced to prevent danger. As shown in FIG. 1(*a*), a Christmas lamp in prior art uses a fixing block 10 to fix two conductive filaments 12 during the fabrication, and there are a plurality of rounds of safety fuse 14 wound around the two conductive filaments 12. After the step of trimming filaments, a tungsten filament 16 is installed at the top end of the two conductive filaments 12, as shown in FIG. 1(*b*). Finally, a lamp casing (not shown) is installed outside to form a complete Christmas lamp. However, during the step of trimming filaments, the two conductive filaments 12 are usually gripped toward each other such that the distance between them is reduced, resulting in loosening of the safety fuse 14 wound around the two conductive filaments 12, as shown in FIG. 1(*b*). The conductivity will thus become worse. Moreover, because a plurality of rounds of safety fuse is needed such that it can be fixed on the two conductive filaments 12, more material of safety fuse is required.

SUMMARY AND OBJECTS OF THE PRESENT INVENTION

Accordingly, the primary object of the present invention is to provide a fixing structure for the safety fuse of a Christmas lamp such that the safety fuse can be exactly fixed to maintain good conductivity.

Another object of the present invention is to provide a fixing structure for the safety fuse of a Christmas lamp such that material of safety fuse can be saved.

According to the present invention, a Christmas lamp has two conductive filaments installed at two sides in a lamp casing. A fixing block is installed in the casing to fix the positions of the two conductive filaments. A tungsten filament is connected between the top ends of the two conductive filaments. The potion of the two conductive filaments between the tungsten filament and the fixing block is bent to form a fixing structure. A small section of safety fuse is exactly fixed on the two conductive filaments through the help of the fixing structure.

The various objects and advantages of the present invention will be more readily understood from the following detailed description when read in conjunction with the appended drawings, in which:

DETAILED DESCRIPTION OF THE PREFERRED EMBODIMENT

The present invention is characterized in that the middle potion of each conductive filament of a Christmas lamp forms a fixing structure to exactly fix a small section of safety fuse on the two conductive filaments.

Figure 1:
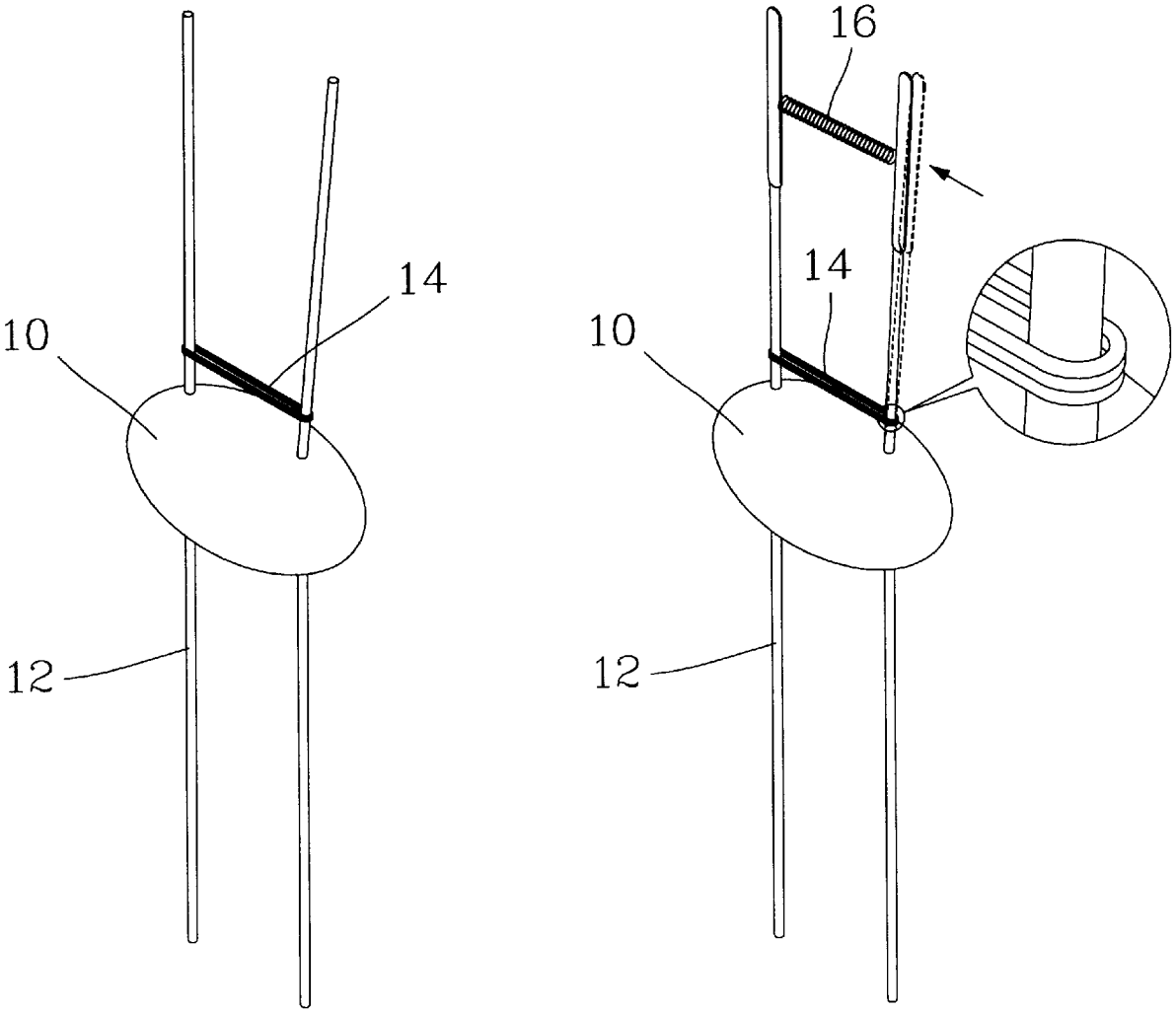
FIG. 1 is a perspective view of the safety fuse of a Christmas lamp in prior art.
Figure 2:
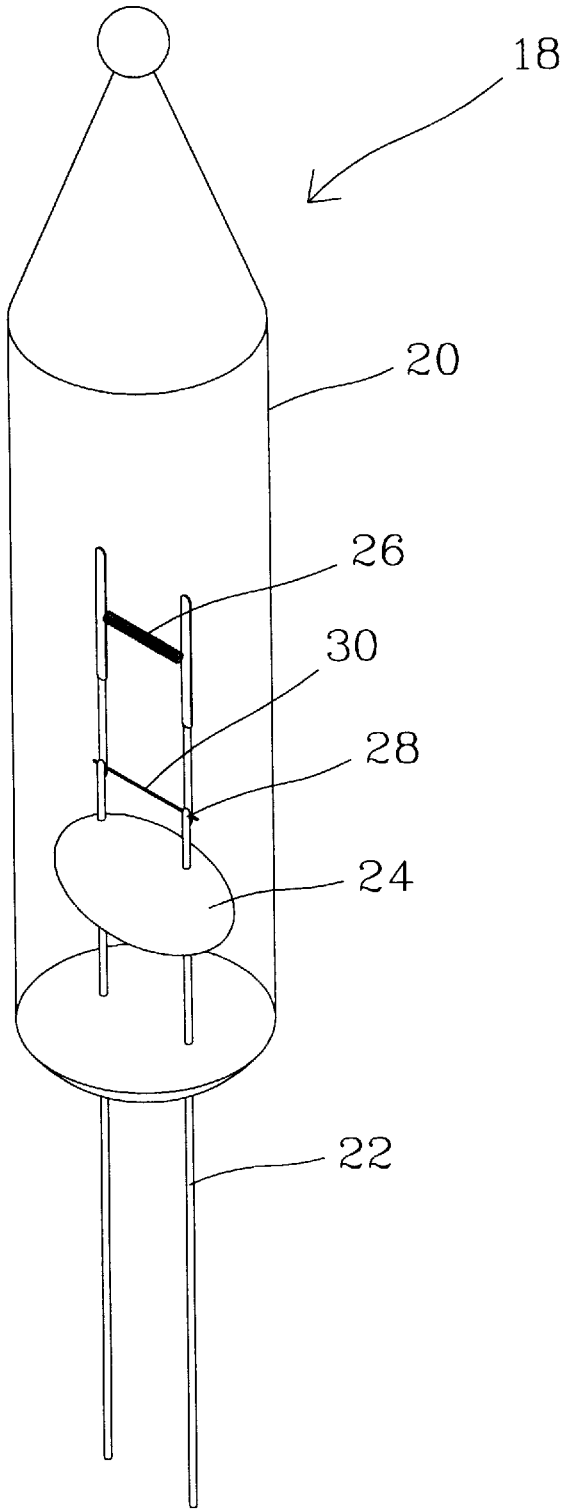
FIG. 2 is a perspective view of a Christmas lamp of the present invention.

As shown in FIG. 2, a Christmas lamp 18 comprises a lamp casing 20. Two parallel conductive filaments 22, generally being magnesium-coated filaments, are installed at two sides in the casing 20. A fixing block 24 is installed at the middle potions of the two conductive filaments 22 to fix their positions. A tungsten filament 26 is connected between the top ends of the two conductive filaments 22. Corresponding positions of the two conductive filaments 22 are bent to form a fixing structure 28. The fixing structure 28 is situated between the tungsten filament 26 and the fixing block 24. A small section of safety fuse 30 is exactly fixed on the two conductive filaments 22 through the help of the fixing structure 28.

Figure 3:
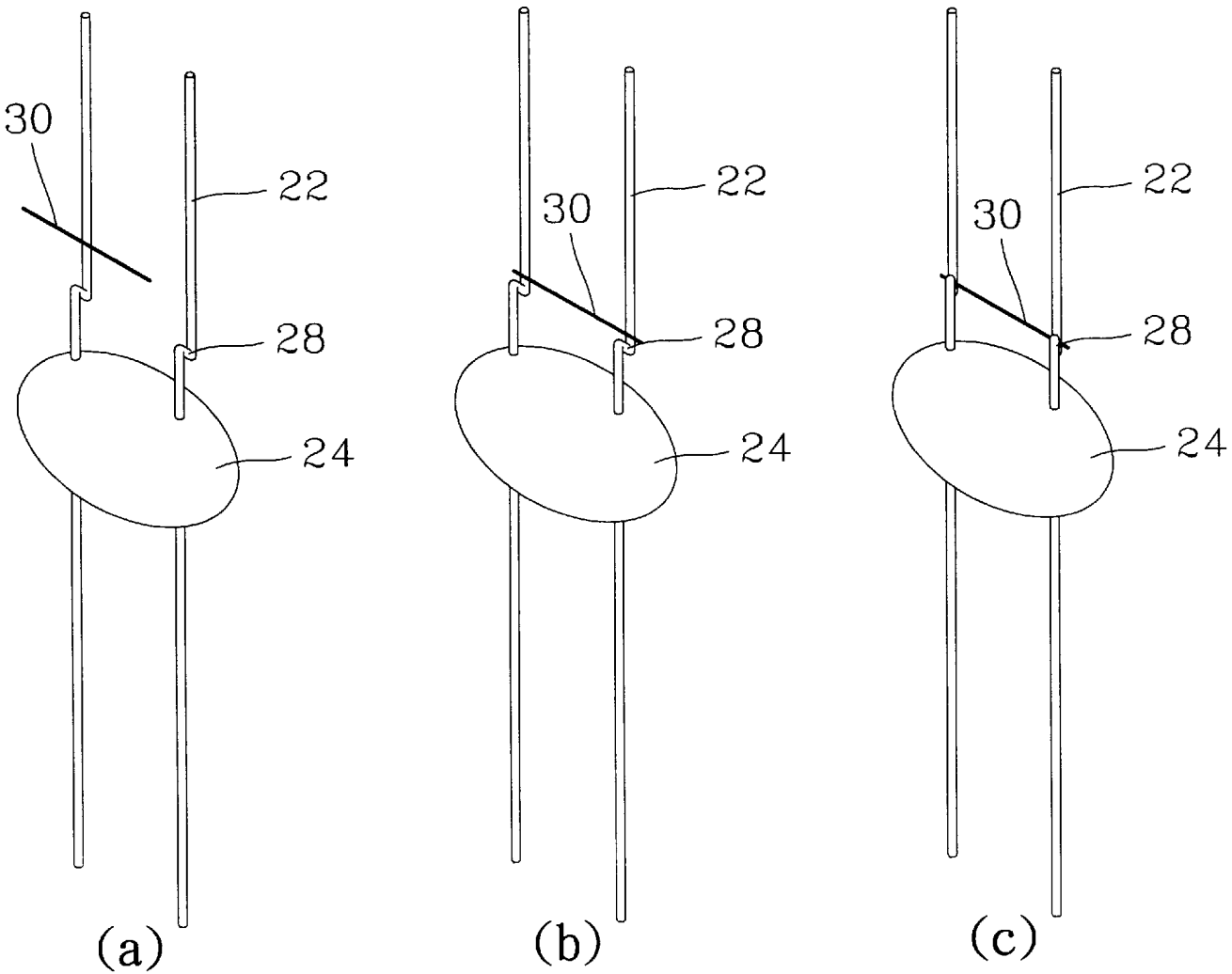
FIGS. 3(*a*) to 3(*c*) are perspective views showing the procedures of installing the safety fuse according to an embodiment of the present invention.

The steps of installing the safety fuse 30 on the fixing structure 28 are shown in FIG. 3. As shown in FIG. 3(*a*), the conductive filament 22 is bent to form an N-shape fixing structure 28. As shown in FIG. 3(*b*), a small section of safety fuse 30 is placed at the bent concavities of the fixing structure 28. As shown in FIG. 3(*c*), the fixing structure 28 is tightly gripped to firmly fix the safety fuse 30 on the two conductive filaments 22.

Figure 4:
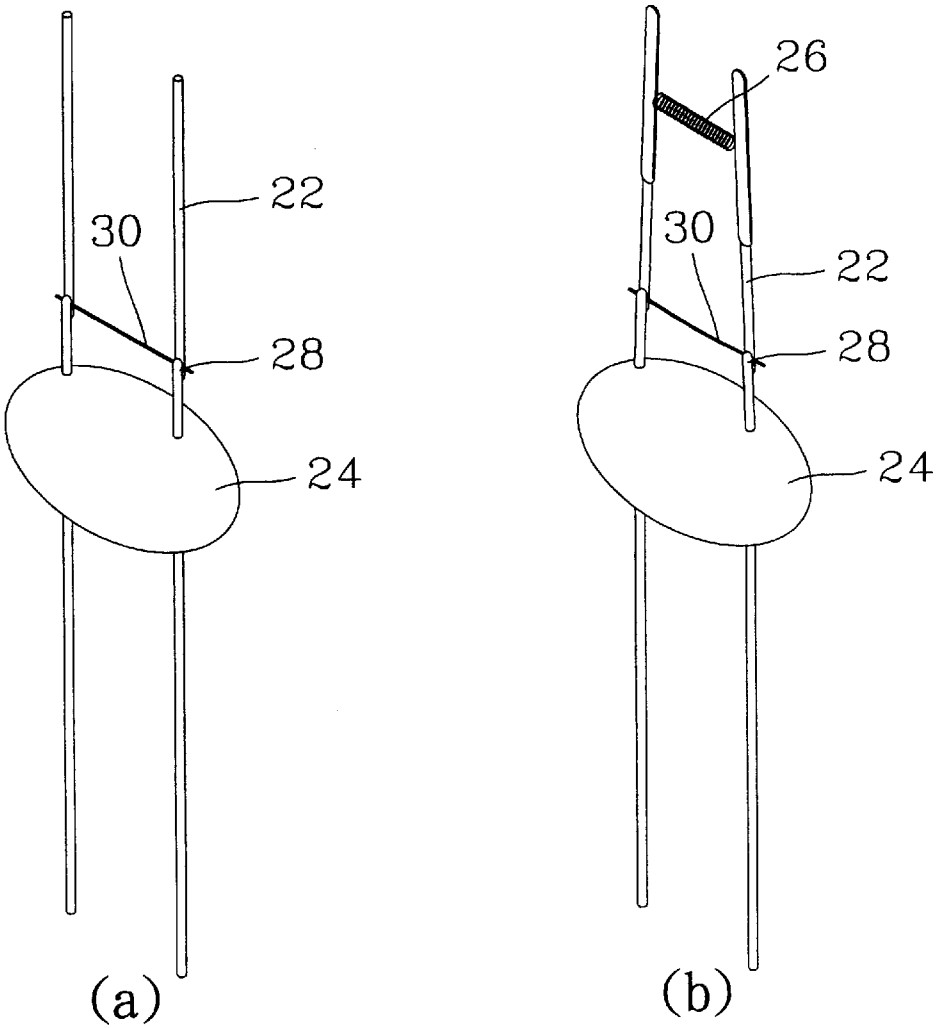
FIGS. 4(*a*) and 4(*b*) are perspective views of a Christmas lamp of the present invention before and after a tungsten filament is installed, respectively.

After the installation of the safety fuse 30, as shown in FIG. 4(*a*), the two conductive filaments 22 must undergo a step of trimming filaments, and a tungsten filament 26 is installed at the top ends of the two conductive filaments 22, as shown in FIG. 4(*b*). In this case, even if the two conductive filaments 22 are gripped toward each other during the step of trimming filaments such that the distance between them is reduced, the safety fuse 30 on the two conductive filaments 22 will not loosen. Good conductivity can thus be maintained. Moreover, it is not necessary to wind a plurality of safety fuse around the two conductive filaments 22. Only a small section of safety fuse is required to be fixed on the two conductive filaments 22. Therefore, material of safety fuse 30 can be saved so as to reduce the cost.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A Christmas lamp with a safety fuse fixing structure, comprising a lamp casing;

a pair of conductive filaments each having a portion thereof extending into said lamp casing, each of said conductive filament portions within said lamp casing having a bent portion respectively formed therein, said bent portions of said pair of conductive filaments defining a fixing structure;

a tungsten filament disposed in said lamp casing and being respectively connected to end portions of said pair of conductive filaments;

a fixing block disposed in said lamp casing and encompassing an intermediate section of each of said pair of conductive filament portions extending into said lamp casing; and, a safety fuse supported by said fixing structure within said lamp casing and connected to said two conductive filaments, said fixing structure being disposed intermediate said tungsten filament and said fixing block.

* * * * *